US011098905B2

(12) United States Patent
Arenas Jimenez et al.

(10) Patent No.: US 11,098,905 B2
(45) Date of Patent: Aug. 24, 2021

(54) HOB WITH OVERHEAT CONTROL DEVICE

(71) Applicant: BSH Hausgeräte GmbH, Munich (DE)

(72) Inventors: Beatriz Arenas Jimenez, La Muela (ES); David Ortiz Sainz, Pinseque (ES); Daniel Palacios Tomas, Saragossa (ES); Carmelo Pina Gadea, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 314 days.

(21) Appl. No.: 16/162,452

(22) Filed: Oct. 17, 2018

(65) Prior Publication Data

US 2019/0154268 A1 May 23, 2019

(30) Foreign Application Priority Data

Nov. 20, 2017 (ES) ..... ES201731339

(51) Int. Cl.

| | |
|---|---|
| ***F24C 15/10*** | (2006.01) |
| ***B65D 71/00*** | (2006.01) |
| ***F24C 7/08*** | (2006.01) |
| ***F24C 15/30*** | (2006.01) |

(52) U.S. Cl.

CPC ..... *F24C 15/105* (2013.01); *B65D 71/0096* (2013.01); *F24C 7/087* (2013.01); *F24C 15/30* (2013.01); *B65D 2571/00049* (2013.01)

(58) Field of Classification Search

CPC ..... F24C 15/105; F24C 7/087; F24C 15/30
USPC ..... 219/445.1, 448.14, 461.1
See application file for complete search history.

(56) References Cited

U.S. PATENT DOCUMENTS

| | | | | |
|---|---|---|---|---|
| 4,243,874 | A * | 1/1981 | Fischer | H05B 3/748 219/448.11 |
| 9,220,130 | B1 * | 12/2015 | Smith | H05B 1/0266 |
| 2007/0228031 | A1 * | 10/2007 | Alves | H05B 3/746 219/448.11 |

FOREIGN PATENT DOCUMENTS

| | | | | |
|---|---|---|---|---|
| DE | 315333 | C | 12/1917 | |
| EP | 0021107 | A1 * | 5/1980 | F24C 15/105 |
| EP | 0021107 | A1 | 1/1981 | |
| EP | 1783434 | A2 | 5/2007 | |
| EP | 2131625 | A1 | 12/2009 | |
| ES | 25428243 | A1 | 11/2013 | |

OTHER PUBLICATIONS

National Search Report ES 201731339 dated Feb. 18, 2019.

* cited by examiner

*Primary Examiner* — Thien S Tran
(74) *Attorney, Agent, or Firm* — Michael E. Tschupp; Andre Pallapies; Brandon G. Braun

(57) ABSTRACT

If hobs are integrated into built-in furniture, care must be taken to ensure that during operation the temperature in or on the built-in furniture does not exceed permissible limit values. It is proposed to fasten a temperature sensor in the hob housing by means of a heat-conducting retaining element. The retaining element is arranged on the hob housing such that essentially the heat output into the worktop is transmitted via the retaining element to the temperature sensor.

11 Claims, 3 Drawing Sheets

HOB WITH OVERHEAT CONTROL DEVICE

CROSS-REFERENCES TO RELATED APPLICATIONS

This application claims the priority of Spanish Patent Application, Serial No. P201731339, filed Nov. 20, 2017 pursuant to 35 U.S.C. 119(a)-(d), the disclosure of which is incorporated herein by reference in its entirety as if fully set forth herein.

BACKGROUND OF THE INVENTION

The invention relates to a hob, which can be inserted into a worktop, and to a method for controlling the hob.

If hobs are integrated into built-in furniture, care must be taken to ensure that during operation the temperature in or on the built-in furniture does not exceed permissible limit values. Since in many cases plastic and wood are used as materials for built-in furniture, here in the case of overtemperature there is not only generally the risk of damage to the built-in furniture, but instead also a specific fire hazard. For the majority of electrical appliances or arrangements of electrical appliances in built-in furniture, a temperature monitoring in the electrical appliance already exists against overheating, for instance in order to avoid excessively high temperatures on a ceramic glass hob plate of a hob.

BRIEF SUMMARY OF THE INVENTION

It would be desirable and advantageous to provide an improved hob to obviate other prior art shortcomings and to ensure a reliable monitoring of the temperature of a built-in furniture and simple operation for a kitchen installer.

The invention is based on a hob, which can be inserted into a worktop and has a temperature sensor for acquiring a heat output into the worktop in the integrated state.

According to one aspect of the present invention, a hob for installation in a worktop includes a hob housing, a temperature sensor configured to acquire a heat output into the worktop in an integrated state, and a heat-conducting retaining element configured to fasten the temperature sensor in the hob housing, the retaining element being arranged on the hob housing such as to substantially transmit the heat output into the worktop to the temperature sensor.

The hob may in particular be an electric hob, for instance an induction hob or a hob with heater spirals.

Such an arrangement of the temperature sensor is particularly easy to assemble in the hob housing. From a mechanical point of view, a solution of this type is compatible with the majority of hob plates and can therefore be inserted without a significant redesign. The heat is routed from the built-in furniture into the interior of the hob housing and to the temperature sensor via the heat-conducting retaining element, so that the measured temperature essentially corresponds to the temperature of the built-in furniture. The arrangement is therefore particularly fault-tolerant.

In one embodiment of the invention, the retaining element can be attached to the hob housing in a thermally insulated manner. This embodiment is particularly advantageous when the hob housing itself is built from a heat-conducting material, for instance metal. This largely prevents the retaining element from forwarding heat stored in the hob housing to the temperature sensor.

According to another advantageous feature of the present invention, the retaining element can be attached to a top side of an external wall of the hob housing. The retaining element is therefore easily accessible and particularly easy to assemble when the hob housing is opened.

According to another advantageous feature of the present invention, the hob can have at least one profiled element, which, in an assembled state, connects a hob plate to the hob housing and in an assembled state aligns at least the hob housing in a cutout of a worktop. The profiled element can hereby in thermal conducting contact with the worktop and the retaining element can be in thermal conducting contact with the profiled element. Advantageously the heat present in the built-in furniture is routed by way of the profiled element to the retaining element and from the retaining element to the temperature sensor. Such a solution is easy to integrate into existing hobs and requires little space.

According to another advantageous feature of the present invention, the profiled element can be connected with a positive fit to an underside of the hob plate.

According to another advantageous feature of the present invention, the retaining element can be embodied as a U-profile with two limbs and a connection to connect the two limbs which forms a supporting surface, wherein the limbs encompass the upper edge of the hob housing and the profiled element rests on the supporting surface. Easy assembly of the retaining element is achieved in this way. The retaining element can be attached particularly advantageously in a projecting tab of the hob housing.

According to another advantageous feature of the present invention, the temperature sensor can be embodied as a resistance temperature sensor, in particular as an NTC sensor. Advantageously a number of temperature sensors can also be fastened in the hob housing by means of heat-conducting retaining elements for the purpose of acquiring a heat output into the worktop in the integrated state.

According to another aspect of the present invention, a method for controlling a hob installed in a worktop, includes monitoring a temperature of the worktop by a temperature sensor; and reducing a power of the hob when the temperature exceeds a temperature threshold value.

Further advantages result from the following description of the drawings. Exemplary embodiments of the invention are shown in the drawing. The drawing, the description and the claims contain numerous features in combination. The person skilled in the art will expediently also individually consider the features and combine them to form useful further combinations.

DETAILED DESCRIPTION OF EXEMPLARY EMBODIMENTS OF THE PRESENT INVENTION

Figure 1:
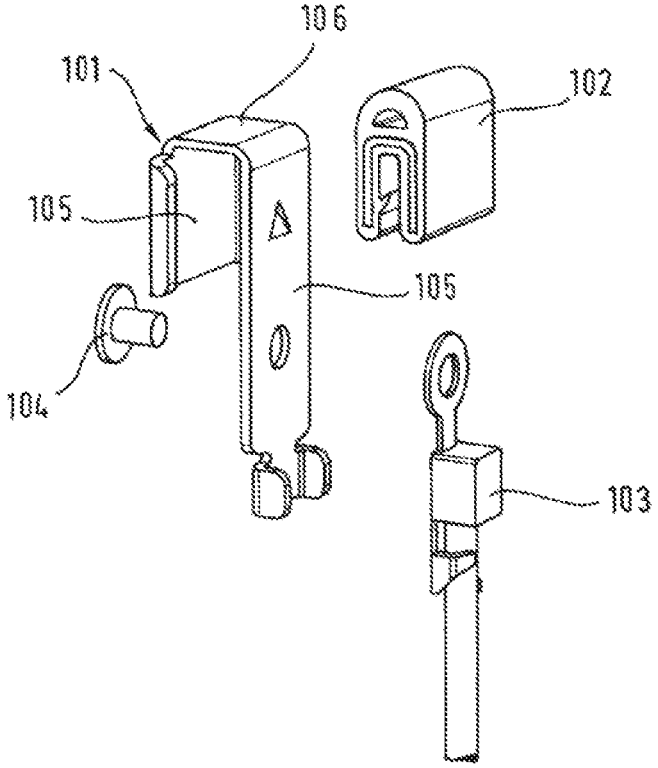
FIG. 1 a schematic individual representation of a retaining element with temperature sensor, FIG. 2 a schematic representation of the retaining element shown in FIG. 1 with a temperature sensor in the assembled state fastened to the hob housing, FIG. 3 a schematic representation of a cutout of a hob housing integrated into the worktop with a temperature sensor fastened to the hob housing, FIG. 4 an enlarged cutout from FIG. 3 with the fastened temperature sensor, FIG. 5 a lateral sectional representation of FIG. 4 with the fastened temperature sensor.

FIG. 1 shows a schematic representation of components for fastening a temperature sensor to a retaining element on the hob housing. The retaining element 101 has a U-shaped profile and is manufactured from a heat-conducting material, for instance metal. The two limbs 105 are of varying lengths, wherein in the integrated state the longer limbs are attached to the hob housing interior. The connection between the two limbs forms a supporting surface 106.

Furthermore, a bracket 102 is shown, which is manufactured from a thermally insulating material, for instance silicon. The bracket 102 is clamped onto a point in the hob housing external wall which is provided herefor. The retaining element 101 is moved by way of the bracket, wherein the bracket exerts a spring force in the direction of the retaining element 101 and thus fixes the same. The thermally insulating material herewith ensures, in the integrated state, that no heat is transmitted from the hob housing to the retaining element 101.

Finally, a temperature sensor 103 is shown in FIG. 1, which in this exemplary embodiment is embodied as an NTC (Negative Temperature Coefficient) sensor. The temperature sensor 103 is connected by means of a fixing element 104 to the retaining element 101 and is in thermal contact with the retaining element 101.

Figure 2:
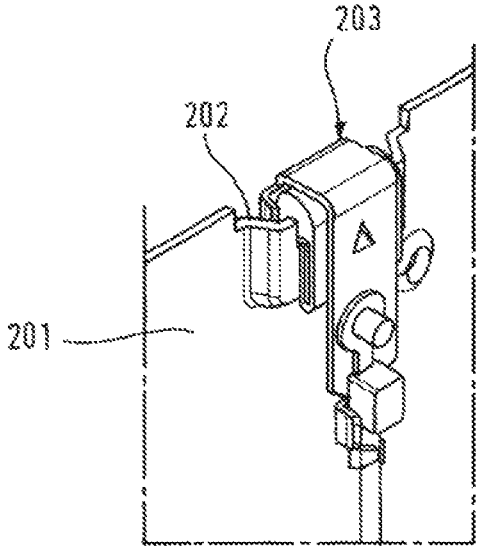

FIG. 2 shows a schematic representation of the retaining element shown in FIG. 1 with a temperature sensor in the assembled state fastened to the hob housing. A cutout of an external wall of a hob housing 201 is shown in a perspective view. A tab 202 is provided at the upper end of the hob housing 201. The tab 202 is projected such that in the integrated state the outer surface of the limb of the retaining element 203 oriented toward the exterior of the hob housing runs essentially flush with the outer surface of the hob housing. Moreover, the tab 202 is dimensioned such that in the integrated state the supporting surface of the retaining element 203 runs flush with the top edge of the hob housing 201.

Figure 3:
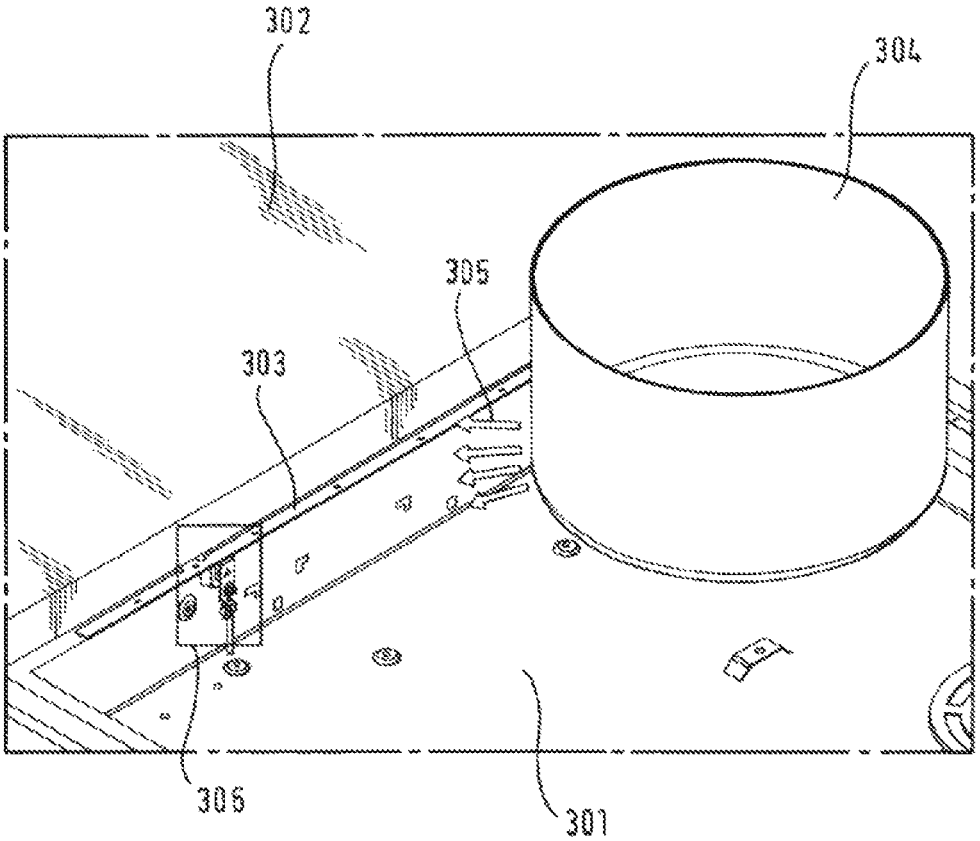

FIG. 3 shows a schematic representation of a cutout of a hob housing integrated into the worktop with a temperature sensor fastened to the hob housing. The hob housing 301 is embedded into the worktop 302 and is aligned in the worktop 302 by way of a profiled element 303. The hob housing generally serves to receive heating elements, for instance induction heating coils or resistance heating coils, and electronic components for operating the heating elements. These are not shown in FIG. 3. Furthermore, a hob plate made from glass or ceramic glass is generally connected with a positive fit to the profiled element 303 and in turn by way of the profiled element 303 to the hob housing 301. This is also not shown in FIG. 3.

For improved illustration FIG. 3 shows a cooking pot 304 which rests on a hob plate (not shown). By way of example, the arrows 305 show the heat output through the cooking pot, which results in the worktop 302 heating up. The cutout in FIG. 3, which shows the temperature sensor fastened to a retaining element, is framed 306. The cutout 306 is shown enlarged in FIG. 4.

Figure 4:
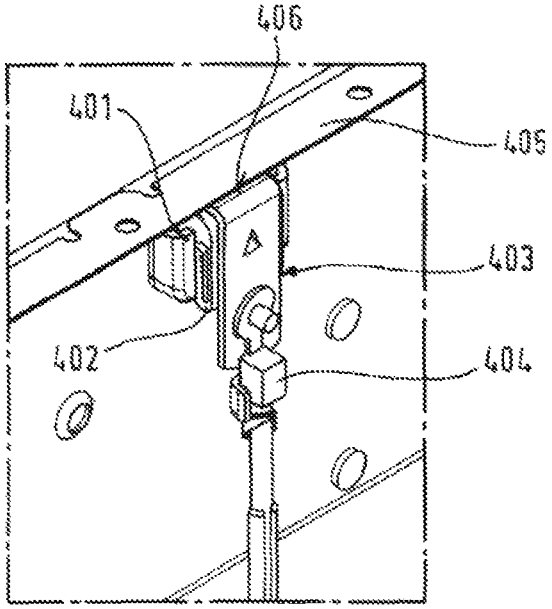

FIG. 4 shows an enlarged extract from FIG. 3. Depicted is a tab 401 projecting into the interior of the hob housing, and to which a heat-insulating silicon bracket 402 is clamped. The retaining element 403 is moved onto the silicon bracket 402 and is retained by a contact pressure exerted by the silicon bracket 402. The temperature sensor 404 is fastened to the retaining element such that it measures a heat transmitted by the retaining element 403.

The profiled element 405 is attached to the hob housing such that it rests on the supporting surface 406 of the retaining element 403 and is in thermal contact herewith. Moreover, the profiled element 405 is provided to align the hob housing in the worktop and is in thermal contact herewith. In this way the heat from the worktop is forwarded by way of the profiled element 405 to the retaining element 403 and from there to the temperature sensor 404. The thermal insulation of the retaining element 403 with respect to the hob housing by means of the silicon bracket 402 ensures that the temperature and thus the heating of the worktop is measured as freely as possible from other external influences.

Figure 5:
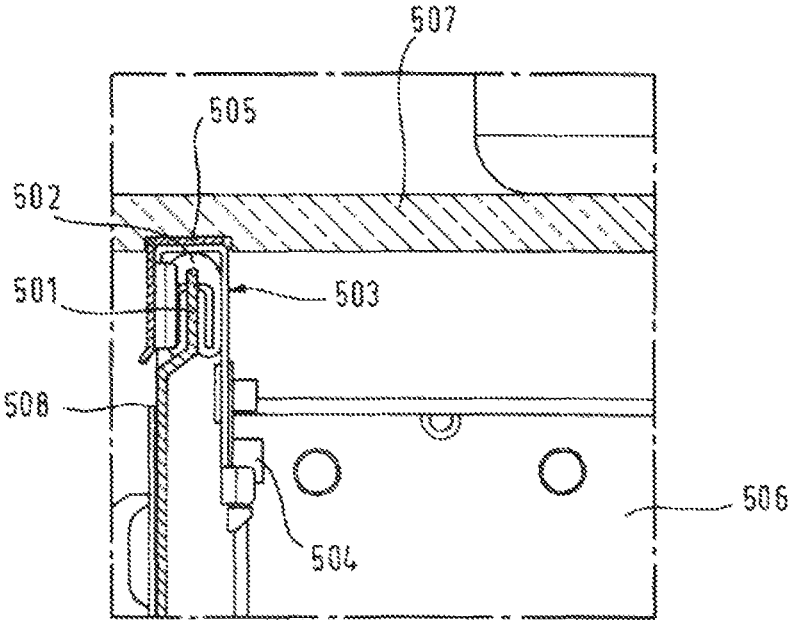

FIG. 5 shows a lateral sectional representation of FIG. 4. A silicon bracket 502 is clamped to the projecting tab 501. The retaining element 503 is in turn moved onto the silicon bracket 502, to which the temperature sensor 504 is fastened.

The profiled element 505 is connected mechanically to the hob housing 506, for instance by way of a screw or clamping connection. The profiled element 505 is connected with a positive fit to the hob plate made from ceramic glass 507. Furthermore, the profiled element 505 serves to align the hob housing in the worktop 508.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed as new and desired to be protected by Letters Patent is set forth in the appended claims and includes equivalents of the elements recited therein:

1. A hob for installation in a worktop, said hob comprising:

a hob housing;

a profiled element attached to the hob housing and configured to be in thermally conducting contact with the worktop;

a thermally insulating bracket that is attached to the hob housing;

a heat-conducting retaining element that is fixed to the thermally insulating bracket and is in thermally conducting contact with the profiled element, the thermally insulating bracket preventing the retaining element from directly contacting the hob housing; and a temperature sensor in thermally conducting contact with the retaining element, said retaining element being configured to fasten the temperature sensor in the hob housing, and being arranged such as to transmit the heat output into the worktop to the temperature sensor.

2. The hob of claim 1, wherein the hob housing includes an external wall, said retaining element being attached to a top side of the external wall of the hob housing.

3. The hob of claim 2, wherein the profiled element is configured to connect in an assembled state, a hob plate to the hob housing and to align the hob housing in an assembled state into a cutout of the worktop.

4. The hob of claim 3, wherein the profiled element is in contact with an underside of the hob plate.

5. The hob of claim 3, wherein the retaining element is embodied as a U-profile with two limbs which encompass an upper edge of the hob housing, and a connection which connects the two limbs and forms a supporting surface, said profiled element resting on the supporting surface.

6. The hob of claim 1, wherein the retaining element is attached in a projecting tab of the hob housing.

7. The hob of claim 1, wherein the temperature sensor is embodied as a resistance temperature sensor.

8. The hob of claim 1, wherein the temperature sensor is embodied as a Negative Temperature Coefficient sensor.

9. The hob of claim 1, further comprising a plurality of said temperature sensor and a plurality of said heat-conducting retaining element to respectively fasten the temperature sensors in the hob housing for acquiring a heat output into the worktop in the integrated state.

10. The hob of claim 1, wherein the thermally insulating bracket exerts a spring force in a direction of the retaining element that fixes the retaining element in place.

11. The hob of claim 1, further comprising a hob plate attached to the hob housing, wherein the temperature sensor is located remotely from the hob plate such that the temperature sensor does not contact the hob plate.

* * * * *